US005864894A

United States Patent [19]

Fedele

[11] Patent Number: 5,864,894

[45] Date of Patent: Feb. 2, 1999

[54] AUTOMATIC SYSTEM FOR PERSONAL HYGIENE FOLLOWING THE CARRYING OUT OF BODILY FUNCTIONS

[75] Inventor: Bruno Fedele, Chiampo, Italy

[73] Assignee: N.T.S. Nuove Tecnologie Sanitarie S.r.l., Malo, Italy

[21] Appl. No.: 871,973

[22] Filed: Jun. 10, 1997

[30] Foreign Application Priority Data

Jun. 12, 1996 [IT] Italy ..... VR96A0056

[51] Int. Cl.[6] ..... A47K 3/22

[52] U.S. Cl. ..... 4/420.2; 4/420.4; 4/213; 4/447

[58] Field of Search ..... 4/213, 239, 420.2, 4/420.4, 420.5, 447, 448

[56] References Cited

U.S. PATENT DOCUMENTS

| | | | |
|---|---|---|---|
| 2,016,542 | 10/1935 | Clark | 4/239 |
| 3,154,793 | 11/1964 | Congdon | 4/420.2 |
| 4,558,473 | 12/1985 | Morikawa et al. | 4/420.2 |
| 4,903,347 | 2/1990 | Garcia et al. | 4/420.4 |

*Primary Examiner*—Robert M. Fetsuga

*Attorney, Agent, or Firm*—Browdy and Neimark

[57] ABSTRACT

An automatic system for personal hygiene following the carrying out of bodily functions, comprising substantially a sanitary bowl (2) connected to a hot-air generator (3) by means of a ventilation circuit (4), and a hot-water generator (5) connected in turn by means of a hydraulic circuit (6) to the water supply mains (7). Said system also comprises a soap storage container (20) linked to the hydraulic circuit (6), and a control device (8) designed to activate, in accordance with programmed operating steps, operation of the system (1). In particular, it also envisages the use of an odor aspirator device (29) connected to the sanitary bowl (2) by means of an air pipe (30, 31) and operated by said control device (8). Advantageously, a sensor (37) for detecting the presence of a person, communicating with the control device (8), is mounted on the seating rim (35) of the sanitary bowl (2). The hydraulic circuit (6) is divided up by a flow distributor (11) into two subsidiary circuits (9, 10), a first one (9) being designed to perform frontal cleaning of a user of the system (1), and a second one (10) being designed to perform rear cleaning of the user. Each subsidiary circuit (9, 10) is connected to the soap storage container (20) by means of a soap-conveying pipe (17) connected to a suction pump (18) and has inserted along it a first delivery pump (14) which is electrically governed by the control device (8).

19 Claims, 4 Drawing Sheets

AUTOMATIC SYSTEM FOR PERSONAL HYGIENE FOLLOWING THE CARRYING OUT OF BODILY FUNCTIONS

BACKGROUND OF THE INVENTION

1. Field of the Invention

The present invention relates to an automatic system for personal hygiene following the carrying out of bodily functions.

The system in question is intended to be used in any sanitary room in domestic dwellings, communal premises, hospitals, etc., for automatically effecting personal hygiene after the carrying out of one's normal bodily functions. In particular, the system according to the present invention may be advantageously used by persons who are not self-sufficient (for example, elderly people), allowing them to clean themselves in an autonomous manner immediately after (or during) the carrying out of their bodily functions. In view of the low cost, the system in question may advantageously also be used in the sanitary premises of a conventional dwelling in keeping with the standards required for thorough and convenient hygiene.

2. Description of the Prior Art

At present, as is known, there exists an automatic system for personal hygiene, described in Italian Patent Application No. 84119A/82, which envisages the use of a series of fairly complex apparatus connected in accordance with a logic/functional diagram which is not able to satisfy in an optimum manner the operational requirements of the user.

In particular, this system of the known type has the drawback that it does not allow varied cleaning of the front and rear zone of the user. This has a negative effect in terms of the flexibility and versatility of operating performance which, for example, does not allow one to repeat several times washing of the single zone concerned.

It should be noted, moreover, that the use of an automatic system for personal hygiene obliges the user to remain in the premises assigned for this purpose for the whole of the time needed to perform the cycle of cleaning operations. Since this system is particularly suitable for persons who are not self-sufficient and who often need to be helped in their actions by other people (for example, in order to undress or dress themselves), remaining for a long time in an area where the air is inevitably contaminated may be a cause of discomfort. The system of the known type (see patent No. 84119A/82) has the drawback that it does not include any technical contrivance for reducing to a minimum the discomfort due to odours.

SUMMARY OF THE INVENTION

The main object of the present invention is therefore that of overcoming the drawbacks of the known art, by providing a system for personal hygiene following the carrying out of bodily functions, which uses equipment which is readily available commercially and low-cost, thus ensuring for the user a high degree of flexibility of use aimed at satisfying every specific requirement. In particular, the present invention allows varied washing of the front and rear intimate zones of the user. A further object of the system in question is that it should be reliable, safe and be equipped with a device for aspiration of the odor, which is connected directly to the sanitary bowl.

BRIEF DESCRIPTION OF THE DRAWINGS

The technical characteristics of the invention, in accordance with the aforementioned objects, may be clearly understood from the contents of the claims indicated below and the advantages thereof will emerge more clearly in the detailed description which follows, provided with reference to the accompanying drawings which show a purely exemplary and non-limiting example of embodiment thereof, in which:

DETAILED DESCRIPTION OF THE PREFERRED EMBODIMENTS

Figure 1:
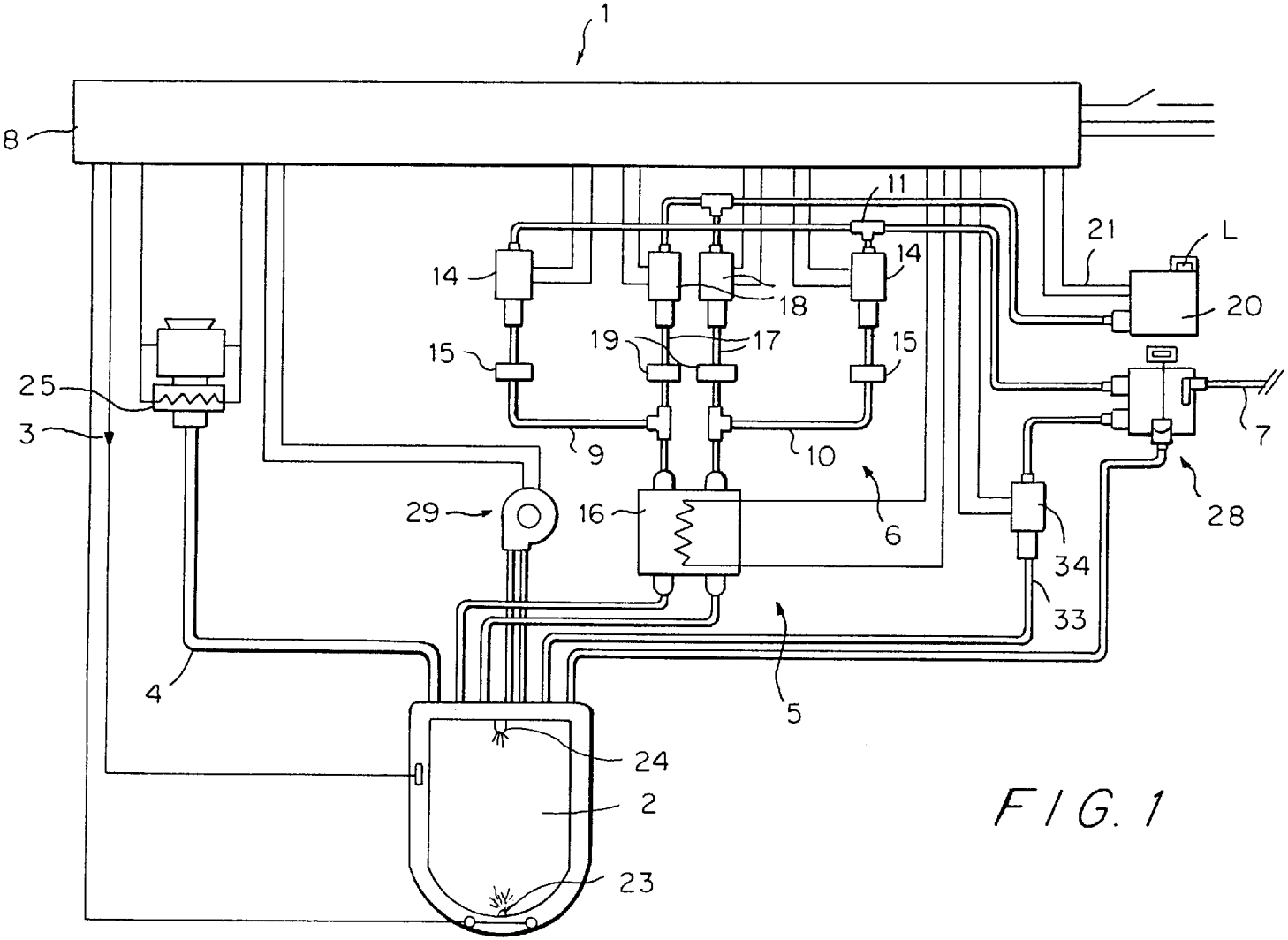
FIG. 1 shows the logic/functional diagram of the principle for installation of the system according to the present invention, in a combined arrangement of the equipment and circuits associated therewith, which make up the system itself.

In accordance with the Figures of the accompanying drawings, 1 denotes in its entirety the automatic system for personal hygiene following the carrying out of bodily functions, according to the present invention.

Said system comprises substantially a sanitary bowl 2 connected to a hot-air generator 3 by means of a ventilation circuit 4, and a hot-water generator 5 connected in turn by means of a hydraulic circuit 6 to the water supply mains 7. It also envisages the use of an electronic control device 8 designed to activate operation of the system in accordance with programmed operating steps.

The hydraulic circuit 6 is divided up by a flow distributor 11 into two subsidiary circuits, a first one 9 and a second one 10, which are substantially identical and connected, upstream, to the water supply mains 7 and, downstream, to the front part 12 and rear part 13 of the sanitary bowl 2, respectively. Each subsidiary circuit 9 and 10 comprises a first delivery pump 14 connected electrically to the control device 8 and provided with a first non-return valve 15 arranged downstream thereof. They have moreover inserted along them, downstream of the first non-return valve 15 and upstream of the sanitary bowl 2, a first thermal heating element 16 which is also operated by the control device 8. Each subsidiary circuit 9 and 10 has flowing into it, upstream of the first thermal heating element 16, a soap-conveying pipe 17 connected by means of a suction pump 18 provided with a second non-return valve 19, to a soap storage container 20. The latter is advantageously provided with a sensor 21 which is able to detect the absence of the water and soap mixture and signal it immediately by means of an indicator lamp L.

Figure 3:
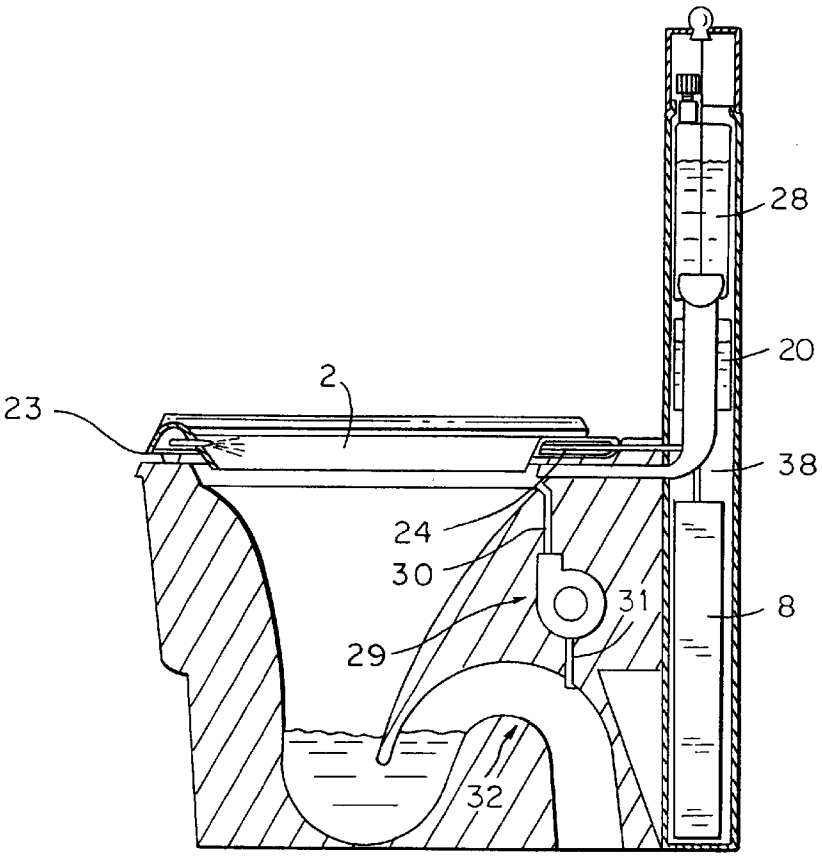
FIG. 3 shows in schematic form a side view of the system in question, sectioned along the line indicated by III—III in FIG. 2.
Figure 2:
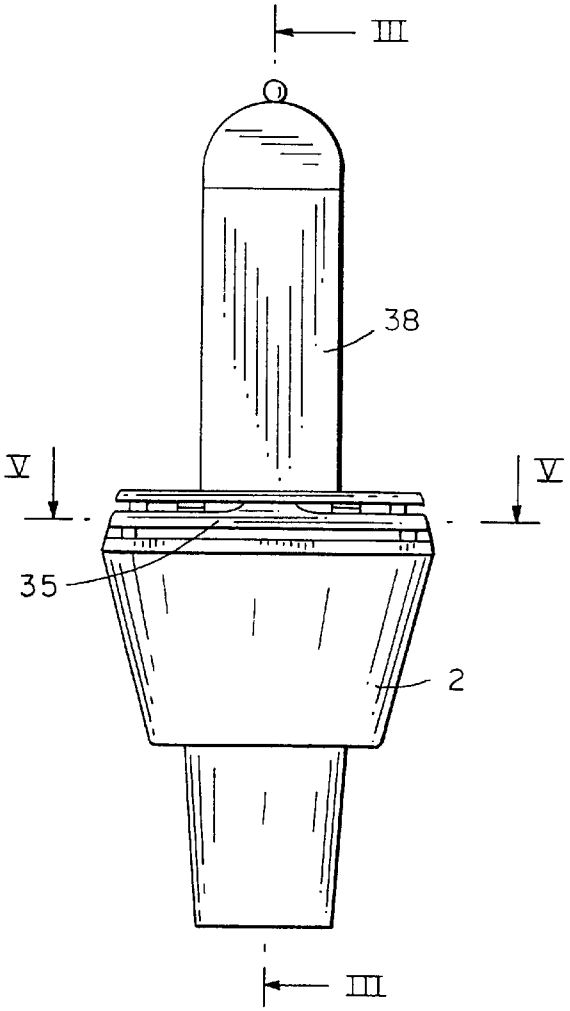
FIG. 2 shows in schematic form a front view of the system in question, with some parts removed so that others may be seen more clearly.
Figure 5:
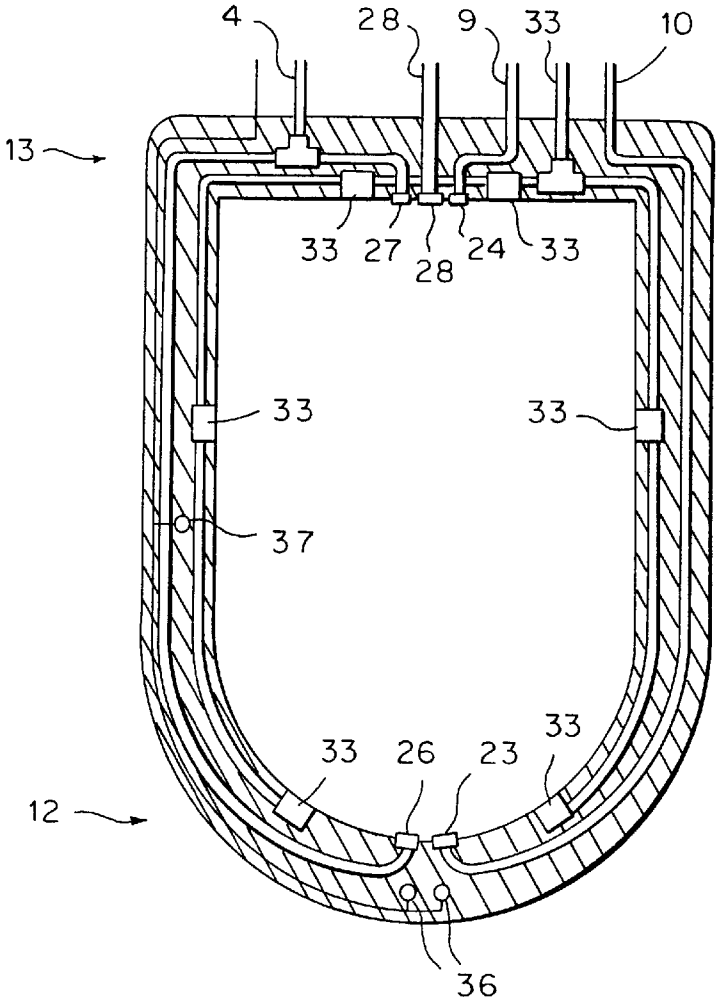
FIG. 5 shows in schematic form a view of an enlarged detail of the system in question, sectioned along the line V—V in FIG. 2.

The first subsidiary circuit 9 and second subsidiary circuit 10 are provided, at their end sections associated with the sanitary bowl 2, respectively with a fan-atomizing spray nozzle 23 and a nozzle 24 with a concentrated and directed jet (see FIGS. 1, 3 and 5).

The hot-air generator 3 consists of a second thermal heating element 25, electrically governed by the control device 8, and a ventilation circuit 4 provided, at one end associated with the sanitary bowl, with two nozzles for delivery of the air, one 26 being arranged in the front part 12, and the other 27 being arranged in the rear part 13 of the sanitary bowl 2 (see FIG. 5).

The sanitary bowl 2 is also provided with a conventional device 28 for flushing thereof (controlled by a flow meter or conventional cistern and float) and an odor aspirator device 29 connected, by means of a suction pipe 30, to the internal volume of the sanitary bowl 2 and, by means of an expulsion pipe 31, to a downstream section 32 of the siphon connected to the drainage system of the sanitary bowl 2 itself.

It should be noted that, in FIG. 1, the electric circuits have been shown in thin lines and the hydraulic and ventilating circuits in bolder lines.

Advantageously, it is envisaged using an auxiliary hydraulic circuit 33 connected to the water supply mains 7 and to the sanitary bowl 2 in order to convey a continuous supply of water to an encrusted zone of the sanitary bowl 2. This auxiliary hydraulic circuit 33 has inserted along it a second delivery pump 34 also governed by the control device 8.

The seating rim 35 of the sanitary bowl 2 has mounted on it two activating pushbuttons 36 which can be easily reached by the user and are designed to transmit two corresponding signals to the control device 8. By means of the selective activation of one of the two pushbuttons 36 or both the pushbuttons 36 the user is able to activate the first, the second or both the subsidiary circuits 9, 10, thus performing washing of the front zone only, the rear zone only or both the front and rear zones.

When the user has performed selection of the zones to be washed by means of the aforementioned activating pushbuttons 36, the control device 8 activates a washing cycle consisting substantially of four cleaning stages: a first one involving washing with hot water; a second one involving washing with hot water and soap; a third one involving rinsing with water; and a fourth one involving drying with hot air.

On the seating rim 35 of the sanitary bowl 2 there is also mounted a sensor 37 for detecting the presence of a person, capable of transmitting a signal to the control device when a user occupies the sitting position. This signal causes, during a first stage of operation of the system 1, activation of the first thermal heating element 16 and the second delivery pump 34. Activation of the second delivery pump 34, as mentioned, causes the prompt supply of a flow of water into the encrusted zone so as to avoid subsequent inconvenient operations involving cleaning of the sanitary bowl 2.

As a result of activation of the first thermal heating element 16, it is possible to perform advanced preheating thereof, intended to ensure the production of a flow of hot water (at the desired temperature) immediately after activation of the cleaning stages by the control device 8.

The system in question has moreover, if required, a seating reducer device 55 having a perimetral configuration similar to that defined by the seating rim 35, but being provided with a central opening 56 having a size suitable for the seating of children. This central opening 56 has dimensions smaller than those defined by the seating rim 35.

In a different constructional solution, the seating rim 35 forms a single body with the sanitary bowl 2 and consists of two shells which can be fixed to one another. In this way it is possible to mount all the components associated with the seating rim 35 in a fixed manner on a first bottom shell 60, i.e. without having to use flexible elements in order to allow the seating rim 35 to be raised and lowered. All the elements which in the preceding constructional solution were inserted inside the seating rim are now mounted more easily on the first bottom shell 60. The latter is mounted on top of the sanitary bowl 2 (by means of screws 62) and is designed to house the following elements: atomizer spray nozzle 23, nozzle 24 with a concentrated and directed jet, the end sections of the activating pushbutton circuits 36 and the sensor 37 for detecting the presence of a person, the air delivery nozzles 26, 27, the end sections of the subsidiary circuits 9, 10, the end section of the auxiliary hydraulic circuit 33, the end section of the conventional flushing device 28, the end section of the ventilation device 4, and the initial section of the suction pipe 30.

A second upper shell 61 is mounted above the first bottom shell 60 so as to form therewith the seating rim 35, providing a sealed closure.

Figure 4:
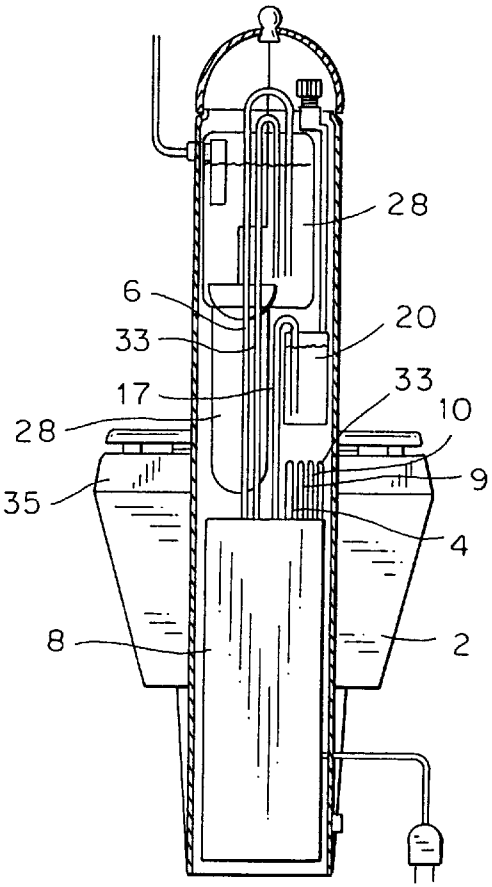
FIG. 4 shows in schematic form a rear view of the system according to FIG. 2, with some parts removed so that others may be seen more clearly.
Figure 6:
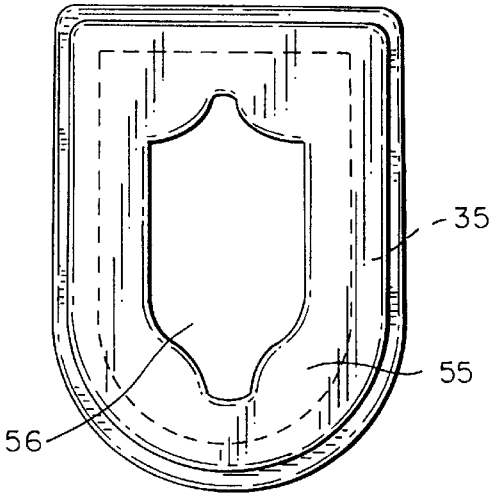
FIG. 6 shows in schematic form a plan view of an accessory (seating reducer device) of the system in question.
Figure 7:
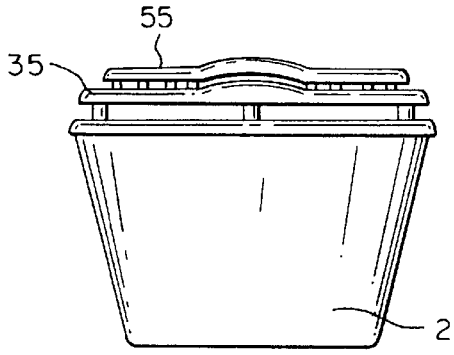
FIG. 7 shows in schematic form a front view of the system in question with the accessory according to FIG. 6, with some parts removed so that others may be seen more clearly.
Figure 8:
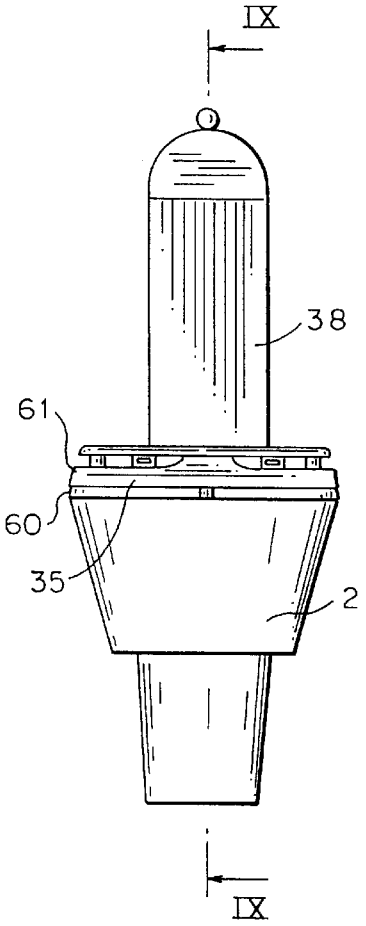
FIGS. 8 and 9 show, respectively, a front view and a sectional view along the line IX—IX of FIG. 8 of the system in question, with a detail (relating to the seating rim) shown in the form of a different constructional solution.
Figure 9:
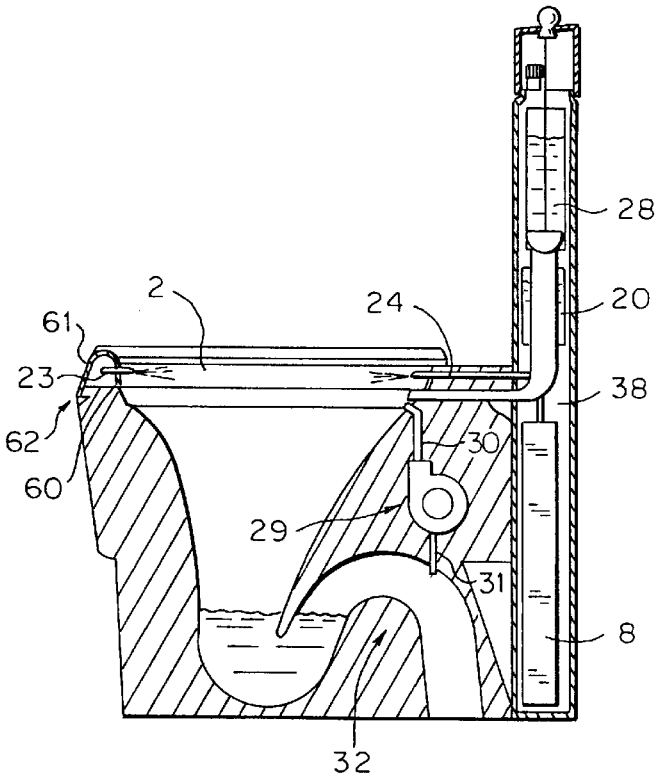

As can be seen in FIG. 4, the conventional device 28 used for flushing, all the pumps 14, 18, 34, the hydraulic circuits 6, 9, 10, 33, ventilation circuit 4 and electrical circuits, the non-return valves 15, 19, the soap storage container 20 and the control device 8 are arranged in a column 38 mounted behind the sanitary bowl 2 so as to limit the overall dimensions of the system 1 and provide a containing structure which is externally pleasing and occupies little space.

It should also be noted that the electrical power supply consists of a low voltage with a value which is not dangerous for the user of the system 1, an ac/dc voltage transformer being provided for this purpose. Advantageously a continuity unit may also be used (not shown in the accompanying figures) for ensuring that the system 1 provides a permanent service even in the event of an interruption in the normal energy supply.

What is claimed:

1. An automatic system for personal hygiene following the carrying out of bodily functions, of the type involving flushing by a conventional valve device (28), comprising: a sanitary bowl (2) connected to said conventional device (28); a hot-water generator (5) associate with a first thermal heating element (16); a hydraulic circuit (6) connected to a water supply main (7) and connecting said hot-water generator (5) to said sanitary bowl (2); a soap storage container (20) communicating with said hydraulic circuit through at least one section pump (18); a hot-air generator (3) communicating with sanitary bowl by means of a ventilation circuit (4) and associated with a second thermal heating element (25); a control device (8) designed to activate, in accordance with programmed operating steps, said hot-water generator (5), said suction pump (18), said hot-water generator (3); wherein said system comprises: an odor aspirator device (29) communicating with the sanitary bowl (2) by means of an air pipe (30, 31) and operated by said control device (8); a sensor (37) for detecting the presence of a person, mounted on the seating rim (35) of the sanitary bowl (2); wherein in said system (1), said hydraulic circuit (6) is divided up by a flow distributor (11) into two subsidiary circuits (9, 10), a first one (9) of which being designed to perform frontal cleaning of a user of the system (1) and a second one (10) of which being designed to perform rear cleaning thereof, each said first subsidiary circuit (9) and second subsidiary circuit (10) communicating with said soap storage container (20) by means of a soap-conveying pipe (17) connected to said suction pump (18) and having a first delivery pump (14) electrically governed by said control device (8) and designed to convey water in a regulated manner from the water supply main (7), through said first thermal heating element (16), to a front part (12) and to a rear part (13) of the sanitary bowl (2), respectively, wherein said odor aspirator device (29) has a suction pipe (30) communicating with an inside of the sanitary bowl (2) and an expulsion pipe (31), communicating with a downstream section (32) of a siphon of the sanitary bowl (2).

2. The automatic system as claimed in claim 1, wherein end section of said first subsidiary circuit (9) and said second subsidiary circuit (10) the sanitary bowl (2) respectively having at least one fan atomizer spray nozzle (23) and at least one nozzle (24) with a concentrated and directed jet.

3. The automatic system as claimed in claim 1, comprising two activating pushbuttons (36) which are arranged on a seating rim (35) of the sanitary bowl (2) and are able to transmit two corresponding signals to the control device (8), designed to cause, selectively, operation of the first subsidiary circuit (10).

4. The automatic system as claimed in claim 3, wherein said control device (8) activates, when the user selects operation of at least one of the two subsidiary circuits (9, 10) by means of said activating pushbuttons (36), a washing cycle substantially consisting of four washing stages, namely a first one involving washing with hot water, a second one involving washing with hot water and soap, a third one involving rinsing with water and a fourth one involving drying with hot air.

5. The automatic system as claimed in claim 1, wherein said control device (8), when activated by said sensor (37) for detecting the presence of a person, causes, during a first operating stage of the system (1), activation of said first thermal heating element (16) and said second delivery pump (34).

6. The automatic system as claimed in claim 1, wherein the soap-conveying pipe (17) is connected to said hydraulic circuit downstream of a first non-return valve (15) in said hydraulic circuit to permit improve mixing of the water with soap from the soap storage container.

7. The automatic system as claimed in claim 1, comprising a seating device (55) designed to be arranged on top of said seating rim (35), said seating reducer device (55) being provided with an external perimetral configuration similar to that of said seating rim (35) and being provided with a central opening (56) having a size suitable for the seating of children.

8. The automatic system according to claim 1, wherein said seating rim (35) forms a single body with said sanitary bowl (2).

9. An automatic system for personal hygiene following the carrying out of bodily functions, of the type involving flushing by a conventional valve device (28), comprising: a sanitary bowl (2) connected to said conventional device (28); a hot-water generator (5) associate with a first thermal heating element (16); a hydraulic circuit (6) connected to a water supply main (7) and connecting said hot-water generator (5) to said sanitary bowl (2); a soap storage container (20) communicating with said hydraulic circuit through at least one suction pump (18); a hot-air generator (3) communicating with sanitary bowl by means of a ventilation circuit (4) and associated with a second thermal heating element (25); a control device (8) designed to activate, in accordance with programmed operating steps, said hot-water generator (5), said suction pump (18), said hot-water generator (3); wherein said system comprises: an odor aspirator device (29) communicating with the sanitary bowl (2) by means of an air pipe (30, 31) and operated by said control device (8); a sensor (37) for detecting the presence of a person, mounted on the seating rim (35) of the sanitary bowl (2); wherein in said system (1), said hydraulic circuit (6) is divided up by a flow distributor (11) into two subsidiary circuits (9, 10), a first one (9) of which being designed to perform frontal cleaning of a user of the system (1) and a second one (10) of which being designed to perform rear cleaning thereof, each said first subsidiary circuit (9) and second subsidiary circuit (10) communicating with said soap storage container (20) by means of a soap-conveying pipe (17) connected to said suction pump (18) and having a first delivery pump (14) electrically governed by said control device (8) and designed to convey water in a regulated manner from the water supply main (7), through said first thermal heating element (16), to a front part (12) and to a rear part (13) of the sanitary bowl (2), respectively, comprising an auxiliary hydraulic circuit (33) which is connected to the water supply main (7) and to the sanitary bowl (2) and having a second delivery pump (34) operated by said control device (8), said auxiliary hydraulic circuit (33) being designed to convey a continuous flow of water to an encrusted zone of the sanitary bowl (2).

10. The automatic system as claimed in claim 9, wherein end sections of said first subsidiary circuit (10) engaged to the sanitary bowl (2) respectively having at least one fan atomizer spray nozzle (23) and at least one nozzle (24) with a concentrated and directed jet.

11. Automatic system as claimed in claim 9, comprising two activating pushbuttons (36) which are arranged on the seating rim (35) of the sanitary bowl (2) and are able to transmit two corresponding signals to the control device (8), designed to cause, selectively, operation of the first subsidiary circuit (9) and the second subsidiary circuit (10).

12. Automatic system as claimed in claim 11, wherein said control device (8) activates, when the user selects operation of at least one of the two subsidiary circuits (9, 10) by means of said activating pushbuttons (36), a washing cycle substantially consisting of four washing stages, namely a first one involving washing with hot water, a second one involving washing with hot water and soap, a third one involving rinsing with water and a fourth one involving drying with hot air.

13. Automatic system as claimed in claim 9, wherein said control device (8), when activated by said sensor (37) for detecting the presence of a person, causes, during a first operating stage of the system (1), activation of said first thermal heating element (16) and said second delivery pump (34).

14. The automatic system as claimed in claim 9, wherein the soap-conveying pipe (17) is connected to said hydraulic circuit downstream of a first non-return valve (15) in said hydraulic circuit to permit improve mixing of the water with soap from the soap storage container.

15. Automatic system as claimed in claim 9, comprising a seating reducer device (55) designed to be arranged on top of said seating rim (35), said seating reducer device (55) being provided with an external perimetral configuration similar to that of said seating rim (35) and being provided with a central opening (56) having a size suitable for the seating of children.

16. Automatic system according to claim 9, wherein said seating rim (35) forms a single body with said sanitary bowl (2).

17. An automatic system for personal hygiene following the carrying out of bodily functions, of the type involving flushing by a conventional valve device (28), comprising: a sanitary bowl (2) connected to said conventional device (28); a hot-water generator (5) associated with a first thermal heating element (16); a hydraulic circuit (6) connected to a water supply main (7) and connecting said hot-water generator (5) to said sanitary bowl (2); a soap storage container (20) communicating with said hydraulic circuit through at least one section pump (18); a hot-air generator (3) communicating with said sanitary bowl by means of a ventilation circuit (4) and associated with a second thermal heating element (25); a control device (8) designed to activate, in accordance with programmed operating steps, said hot-water generator (5), said suction pump (18), said hot-water generator (3); wherein said system comprises: an odor aspirator device (29) communicating with the sanitary bowl (2) by means of an air pipe (30, 31) and operated by said control device (8); a sensor (37) for detecting the presence of a person, mounted on the seating rim (35) of the sanitary bowl (2); wherein in said system (1), said hydraulic circuit (6) is divided up by a flow distributor (11) into two subsidiary circuits (9, 10), a first one (9) of which being designed to perform frontal cleaning of a user of the system (1) and a second one (10) of which being designed to perform rear cleaning thereof, each said first subsidiary circuit (9) and said second subsidiary circuit (10) communicating with said soap storage container (20) by means of a soap-conveying pipe (17) connected to said suction pump (18) and having a first delivery pump (14) electrically governed by said control device (8) and designed to convey water in a regulated manner from the water supply main (7), through said first thermal heating element (16), to a front part (12) and to a rear part (13) of the sanitary bowl (2), respectively, wherein said seating rim consist of two shells which can be fixed to one another, a first bottom shell (60) fixed above the sanitary bowl (2) housing an atomizer spray nozzle (23), a nozzle (24) with a concentrated and directed jet, end sections of electrical circuit associated with activating pushbuttons (36), a sensor (37) for detecting the presence of persons, air delivery nozzles (26, 27), end sections of said subsidiary circuits (9, 10), an end section of an auxiliary hydraulic circuit (33), an end section of said conventional flushing device (28), an end section of said ventilation device (4), and an initial section of a suction pipe (30); and a second upper shell (61) being designed to provide a hermetic closure on said bottom shell (60), forming therewith said seating rim (35).

18. The automatic system as claimed in claim 17, wherein end section of said first subsidiary circuit (10) engaged to the sanitary bowl (2) respectively having at least one fan atomizer spray nozzle (23) and at least one nozzle (24) with a concentrated and directed jet.

19. The automatic system as claimed in claim 17, comprising two activating pushbottons (36) which are arranged on a seating rim (35) of the sanitary bowl (2) and are able to transmit two corresponding signals to the control device (8), designed to cause, selectively, operation of the first subsidiary circuit (9) and the second subsidiary circuit (10).

* * * * *